United States Patent [19]

Nagy

[11] Patent Number: 4,482,177

[45] Date of Patent: Nov. 13, 1984

[54] STRIKER PLATE AND SECURITY PIN FOR DEAD BOLT LOCK

[75] Inventor: David L. Nagy, Chicago, Ill.

[73] Assignee: Daniel F. Domenjoud, Chicago, Ill. ; a part interest

[21] Appl. No.: 425,045

[22] Filed: Sep. 23, 1982

[51] Int. Cl.[3] ..... E05C 1/16

[52] U.S. Cl. ..... 292/156; 292/150; 292/264; 292/341.15

[58] Field of Search ..... 292/150, 341.15, 264, 292/302, 156, 150, 218

[56] References Cited

U.S. PATENT DOCUMENTS

| | | | |
|---|---|---|---|
| 1,253,169 | 1/1918 | Goodsell | 292/150 |
| 1,364,757 | 1/1921 | Herrman | 292/150 |
| 1,924,627 | 8/1933 | Segal | 292/264 X |
| 3,936,085 | 2/1976 | Long | 292/264 |

*Primary Examiner*—Richard E. Moore

*Attorney, Agent, or Firm*—Harvey B. Jacobson

[57] ABSTRACT

A striker plate attached to the door frame or door jamb associated with a door provided with a dead bolt lock of the type having vertically reciprocating bolts received in aligned apertures in a pair of lugs attached to the strike plate. In the present invention, the strike plate is provided with lugs having a larger than normal area and which project inwardly of the body of the lock and have a second pair of aligned apertures for receiving a security pin so that when the security pin is in position, the door cannot be opened even if the lock bolts are retracted. In addition, the lugs have a third pair of aligned apertures receiving the security pin which has a safety chain or cable attached thereto and anchored to the lock or door so that the door can be opened a limited distance when the lock bolts are retracted thereby enabling an occupant to safely open the door a limited amount in order to determine whether the door should be completely opened or not.

7 Claims, 4 Drawing Figures

STRIKER PLATE AND SECURITY PIN FOR DEAD BOLT LOCK

BACKGROUND OF THE INVENTION

1. Field of the Invention

The present invention generally relates to lock devices associated with doors such as those employed in homes, apartments and the like and more specifically relates to a novel and unique strike plate for association with a dead bolt lock of the type including a pair of vertically reciprocating bolts or pins which are supported in projecting and vertically spaced components of the lock with the vertically reciprocating lock bolts being received in a pair of aligned apertures on a pair of lugs integrally formed with the strike plate. The aforementioned strike plate and lock structure is conventional and commercially available with the improvement of the present invention including a pair of lugs on the strike plate of greater area than normal with the lugs including two additional pairs of aligned apertures to receive a security pin which, when in one pair of apertures will prevent the door from opening by preventing the projections on the lock from moving outwardly in relation to the lugs and in another pair of apertures, the security pin will permit limited opening movement of the door by the provision of a safety chain or cable attached to the pin and to the lock body or door.

2. Description of the Prior Art

Many types of locks, safety chains and other security devices have been provided for maintaining a door in closed position or limiting opening movement thereof to preclude unauthorized entry through the doorway. One type of door lock which is commercially available includes spaced projections at the edge of the door having vertically reciprocal lock bolts or pins mounted therein which are reciprocated by a key, knob or the like with the lock bolt being received in a pair of aligned apertures formed in vertically spaced lugs rigid with a strike plate fixedly secured to the door frame. While such locks preclude operation of the lock bolt by inserting a thin tool or other instrument, it still permits entry if the lock is picked or if an unauthorized person has a key which actuates the lock. The following U.S. patents relate to safety lock structures.

U.S. Pat. No. 1,251,117 issued 08/31/20;
U.S. Pat. No. 1,364,757 issued 01/04/21;
U.S. Pat. No. 3,179,458 issued 04/20/65;
U.S. Pat. No. 3,806,176 issued 04/23/74.

SUMMARY OF THE INVENTION

An object of the present invention is to provide a striker plate and security pin for dead bolt locks of the type having vertically reciprocal lock bolts or pins associated with apertured lugs on the strike plate with the present invention including lugs having multiple apertures receiving a security pin having a safety chain or cable attached thereto and attached to the bolt or screw which secures the lock to the door.

Another object of the invention is to provide a strike plate and security pin in accordance with the preceding object in which the lugs on the strike plate include three pairs of apertures, one normally receiving the lock bolts, one receiving the security pin in a position to prevent opening of the door even if the lock bolts are retracted and one receiving the security pin to enable limiting opening movement of the door to enable observation of the space outside of the door while precluding unauthorized entry through the doorway.

A further object of the invention is to provide a strike plate and security pin as set forth in the preceding objects in which the lugs and the apertures therein are so arranged that when the security pin is in the pair of holes to prevent opening movement of the door even if the lock is operated, it is located in the path of movement of vertically spaced projecting portions of the lock body and when the pin is in the position enabling limited opening movement of the door, it is positioned in the pair of apertures not in the path of movement of the projections on the lock body with the safety chain or cable being attached to the top of the pin and securely anchored to the lock body thereby securely limiting opening movement of the door with the safety chain or cable also serving to tether the security pin so that it will be retained in readily usable position when the door and lock are actuated in the usual manner.

Still another object of the present invention is to provide a strike plate and security pin for dead bolt locks which are simple in construction, easily installed, effective in maintaining security and adding very little additional costs to existing lock and strike plate structures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
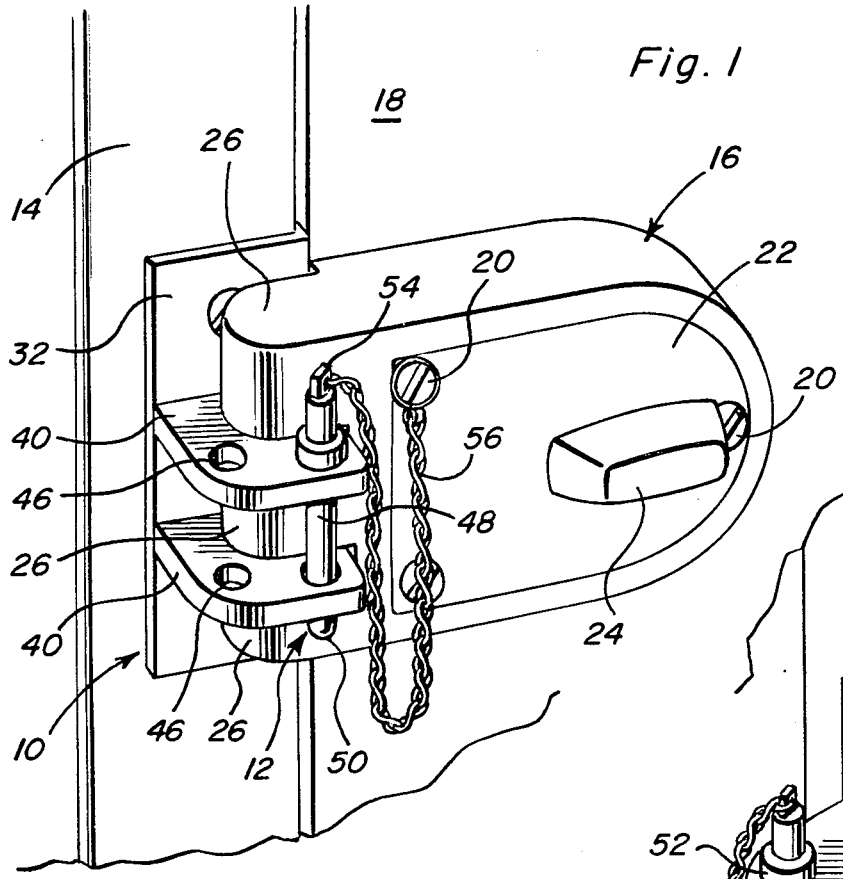
FIG. 1 is a perspective view of the strike plate and security pin of the present invention associated with the conventional dead bolt lock, door and door frame.

Referring now specifically to the drawings, the strike plate of the present invention is generally designated by numeral 10 and the security pin is generally designated by numeral 12 with the strike plate 10 being secured to the door frame or door jamb 14 in a conventional or well known manner. A dead bolt lock generally designated by numeral 16 is attached to the inner surface of the door 18 in a conventional manner such as by the use of mounting screws or bolts 20 which extend through the lock body 22 and the door 18 in a conventional and well known manner. The lock 16 includes an external lock cylinder arrangement for receiving a key to operate the lock and the interior of the lock 16 may be provided with a manually operated knob 24 which also may optionally have a key operated lock cylinder arrangement. This type of lock is conventional and well known and the lock body 12 includes three projections 26 which extend beyond the free edge of the door 18 and include vertically reciprocal lock bolts or pins 28 which are reciprocated in response to the knob 24 or the key operated mechanism so that the lock pins or bolts 28 are either received completely within the projections 26 or extend across the space between the projections 26 in a well known manner.

The strike plate 10 includes a pair of plate members 30 and 32 oriented in perpendicular relation with the plates having apertures 34 for receiving wood screws 36 or other fastening means securing the strike plate to the door jamb with the strike plate being recessed into the surface of the door jamb if desired so that it does not interfere with movement of the door 18 into engagement with the usual door stop 38. All of the aforementioned structure is conventional and normally, the plate 32 which is disposed against the inner surface of the door jamb 14 is provided with a pair of parallel, vertically spaced lugs 40 thereon with the lugs having a pair of vertically aligned apertures 42 therein to reciprocally receive the lock bolts or pins 28 in order to lock the door 18 in closed position when the lock bolts or pins are received in the apertures 42 in the lugs 40. The aforementioned structure, other than the security pin 12 represents conventional lock and strike plate structure which is commercially available.

Figure 2:
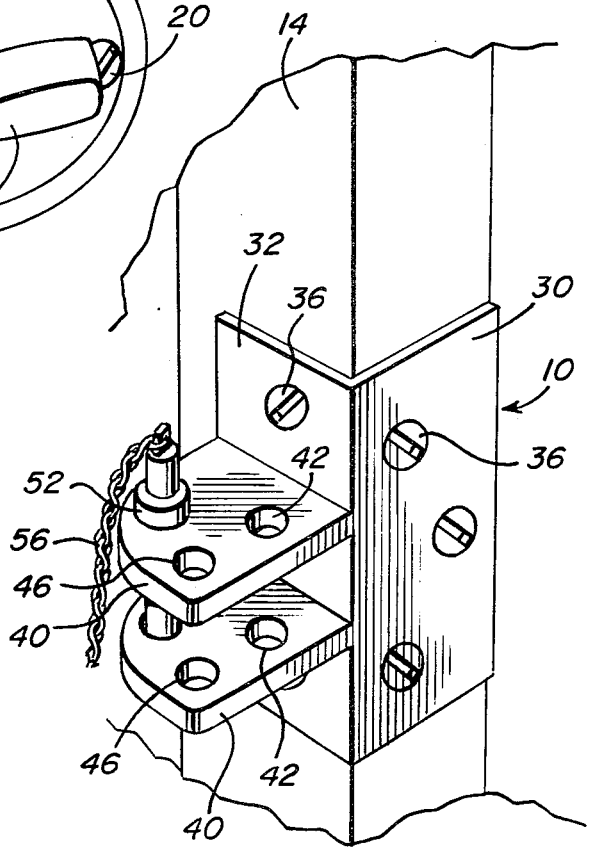
FIG. 2 is a perspective view of the strike plate, lugs thereon and the security pin positioned in one pair of apertures.
Figure 3:
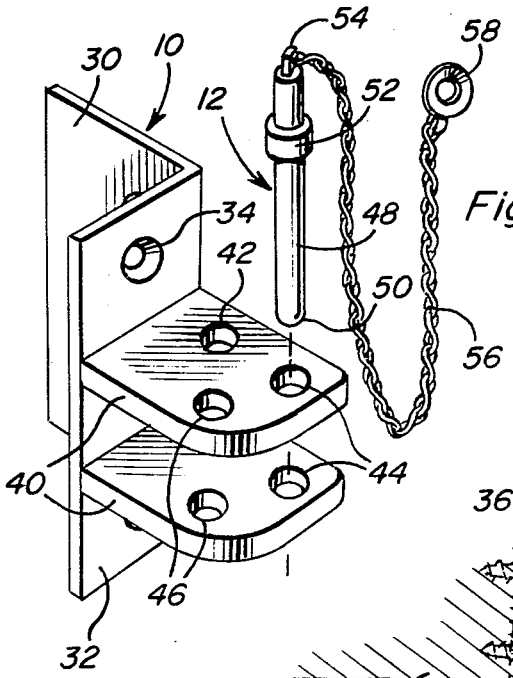
FIG. 3 is an exploded group perspective view of the strike plate, security pin and safety chain.
Figure 4:
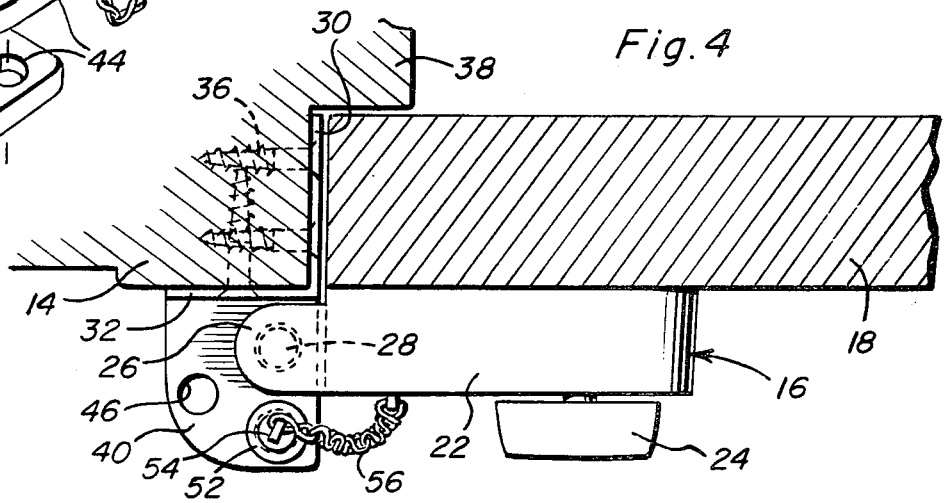
FIG. 4 is a plan view of the present invention illustrating the association of the components when the security pin is in position to preclude opening of the door even if the lock is actuated.

Each of the lugs 40 are enlarged beyond their normal size so that they extend laterally beyond the projections 26 when the door is in locked position as illustrated in FIG. 4 and also extend longitudinally beyond the ends of the projections 26 as illustrated in FIG. 4. The portion of the lugs 40 which extend laterally beyond the projections 26 are provided with an aligned pair of apertures 44 which generally are in alignment with the apertures 42 in that a straight line extending perpendicularly from the plate 32 will pass through the center of the apertures 42 and the center of the apertures 44. The portion of the lugs 40 which extend beyond the longitudinal end portion of the projections 26 also have a pair of apertures 46 therein which are aligned and which are disposed out of the path of movement of the projections 26 during opening and closing movement of the door 18. The security pin 12 includes a cylindrical shank 48 having a rounded lower end 50 and a peripheral collar 52 adjacent its upper end with the upper end of the shank including an anchor loop 54 having one end of a safety chain 56 securely attached thereto. The other end of the safety chain 56 is provided with a rigid and strong ring 58 which is positioned under the head of the mounting screw or bolt 20 as illustrated in FIG. 1. In lieu of the chain 56, the flexible member may be in the form of a cable or the like and have a length predetermined to enable the door to be opened several inches when the pin 12 is in the pair of apertures 46 as illustrated in FIG. 2 with the chain 56 serving as a safety chain that prevents complete inward movement of the door. This enables the door to be unlocked and partially opened so that an occupant of the home, apartment or the like can observe the area outside of the door without permitting entry through the doorway. When it is desired to preclude any opening movement of the door 18 regardless of actuation of the lock 16, the security pin 12 is placed in the pair of apertures 44 as illustrated in FIG. 4 so that the projections 26 will engage the pin 12 and be precluded from moving past the pin 12 thereby preventing the door 18 from being opened even though the lock 16 may be actuated. Thus, with this construction, the security pin may be used to maintain the door 18 completely closed even though the lock may be actuated by an appropriate key, picked or actuated by the knob 24. When the pin is placed in the apertures 46, the door can be opened after the lock has been actuated but only for a limited distance as determined by the safety chain or cable 56 thereby enabling the area externally of the door to be observed while precluding the door from opening completely inwardly thereby precluding entry through the doorway until the security pin 12 has been removed. The safety chain 56 also tethers the security pin in position for easy access when it is desired to use the security pin.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A strike plate and security pin for a dead bolt lock of the type including a vertically reciprocal inch bolt, said strike plate including a projecting lug having an aperture adapted to receive the lock bolt when extended into locking position for use in retaining a door in closed position, that improvement comprising the lug having an extending area having an aperture therein adapted to be disposed in the path of the portion of the lock having the lock bolt associated therewith, and a security pin extending through the aperture in the extending area of the lug on the strike plate to prevent movement of the lock even when the lock bolt is retracted, the lock including a pair of lock bolts, the strike plate including a pair of lugs each having an aperture for receiving a lock bolt, each of said lugs including an extending area each having an aperture therein receiving the security pin.

2. The structure as defined in claim 1 wherein said pair of lugs includes an additional pair of apertures adapted to be disposed outwardly of the path of movement of the lock and lock bolts during opening and closing movement of a door with the additional apertures receiving the security pin.

3. The structure as defined in claim 2 together with a flexible safety member attached to the pin and adapted to be connected to the lock to limit opening movement of a door when the security pin is in the additional pair of apertures in the lugs, said flexible safety member being connected to the security pin.

4. The structure as defined in claim 3 wherein said security pin includes a collar limiting the insertion of the security pin into the apertures with gravity retaining the security pin in place, said security pin including an apertured member at the upper end thereof, said safety member including a chain attached to the apertured upper end of the security pin with the other end of the chain including a ring adapted to be inserted under a fastening member for securing the lock to the door.

5. In combination with a door frame and a closure door movably supported for movement between open and closed positions with respect to the passageway formed by the door frame, a lock mounted on one of the door frame and door, a strike plate mounted on the other of the door frame and door, said strike plate including an apertured lug rigid therewith, said lock including a lock bolt selectively movable into the apertured lug to selectively lock the door in closed position, said lug including an extending area projecting beyond the lock in the direction in which the door opens, said extending area of the lug including an aperture, and a pin manually insertable in said aperture in the extending area of the lug, said pin extending in the path of opening movement of the lock when in the aperture in the extending area of the lug to selectively preclude opening movement of the door when the lock bolt is retracted from engagement with the apertured lug.

6. The combination as defined in claim 5 wherein said pin has a flexible safety line attached thereto and to the door, said extending area of the lug also including an aperture therein oriented out of the path of movement of the lock, said pin being manually insertable in the aperture out of the path of movement of the lock with the length of the safety line enabling the lock to move a limited distance toward its open position without providing complete access through the passageway.

7. In combination, a pivotal closure member having a lock mounted adjacent the swinging edge thereof, a strike plate mounted on a stationary member adjacent the lock when the closure member is in closed position, said strike plate including a projecting lug thereon having recess means, said lug being disposed out of the path of movement of the closure member, said lock including a portion extending beyond the swinging edge of the closure member and positioned in registry with the lug when the closure member is in closed position, said lock including a movable lock bolt engageable with the recess means in the lug to releasably secure the closure member in closed position, said lug including an area extending beyond the portion of the lock in registry with the lug when the closure member is in closed position and security means on said extending area of the lug positionable in the path of movement of the portion of the lock in registry with the lug to prevent movement of the closure member toward open position.

* * * * *